United States Patent [19]

Broyden

[11] 4,448,397

[45] May 15, 1984

[54] PNEUMATIC POWERED HOIST

[75] Inventor: Robert H. Broyden, Williamsville, N.Y.

[73] Assignee: Columbus McKinnon Corporation, Amherst, N.Y.

[21] Appl. No.: 440,850

[22] Filed: Nov. 12, 1982

[51] Int. Cl.[3] ..... B66D 3/20; B66D 3/26

[52] U.S. Cl. ..... 254/360

[58] Field of Search ..... 254/314, 360; 60/370, 60/456, 469; 91/462; 92/78

[56] References Cited

U.S. PATENT DOCUMENTS

| | | | |
|---|---|---|---|
| 2,191,326 | 2/1940 | Smith et al. | 92/78 |
| 2,823,775 | 2/1958 | Zwayer | 254/360 X |
| 3,125,200 | 3/1964 | Kaman | 254/360 X |
| 3,534,553 | 10/1970 | Norton et al. | 60/370 X |

*Primary Examiner*—John Petrakes
*Assistant Examiner*—Joseph J. Hail, III
*Attorney, Agent, or Firm*—Bean, Kauffman & Bean

[57] ABSTRACT

There is disclosed a pneumatic powered hoist wherein the motor driving the load lift wheel is located within a substantially sealed housing which also encloses the hoist gear and brake mechanisms. The motor exhausts into the housing allowing the exhaust to expand and circulate throughout the housing while cooling and lubricating the mechanisms therein and exit through restricted chain guides leading to and from the load lift wheel; the exhaust further expanding and cooling and lubricating the chain. The high pressure, staccato exhausts from the motor are attenuated and muffled interiorly of the housing.

6 Claims, 4 Drawing Figures

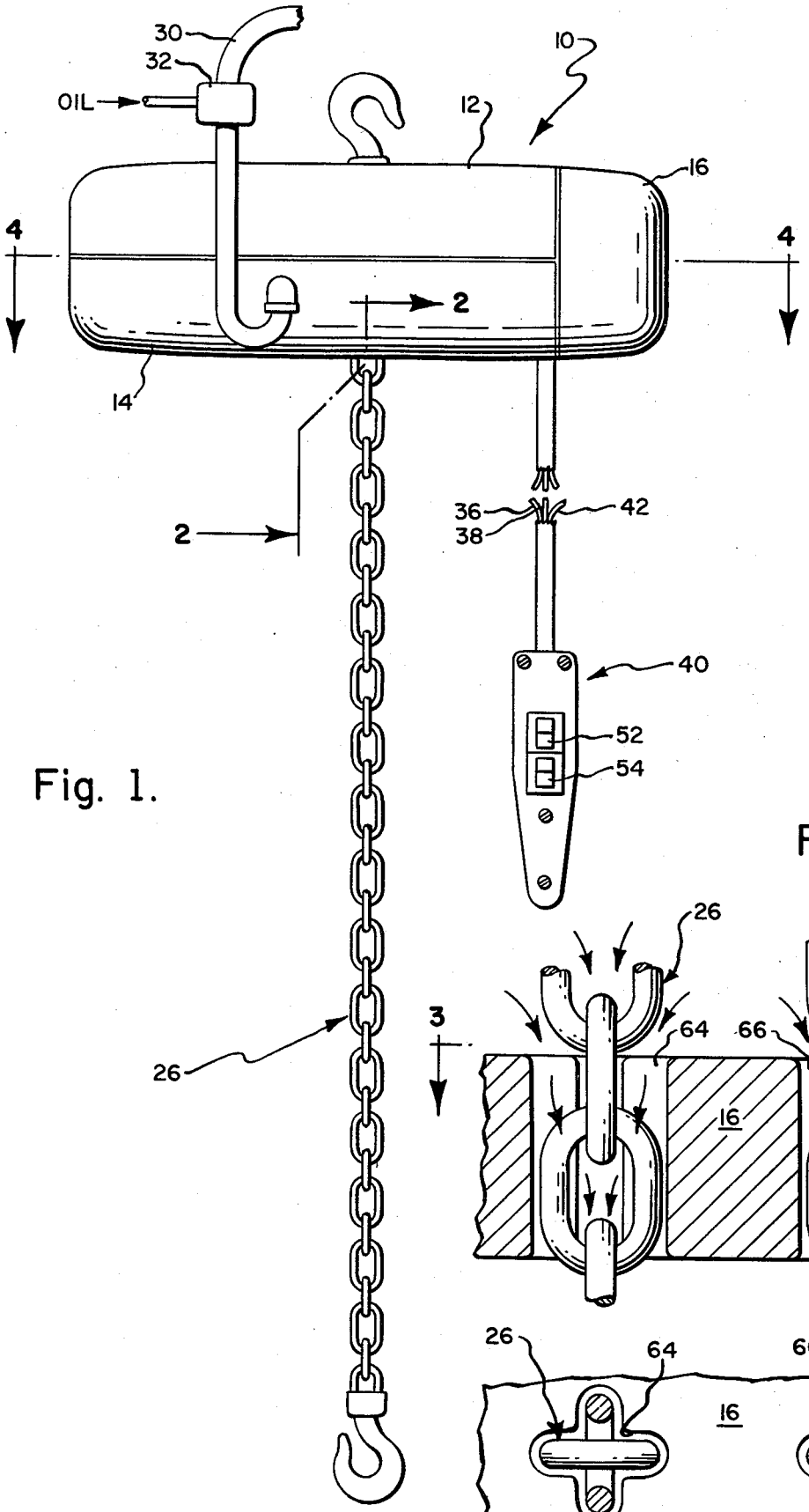
Fig. 1.
Fig. 2.
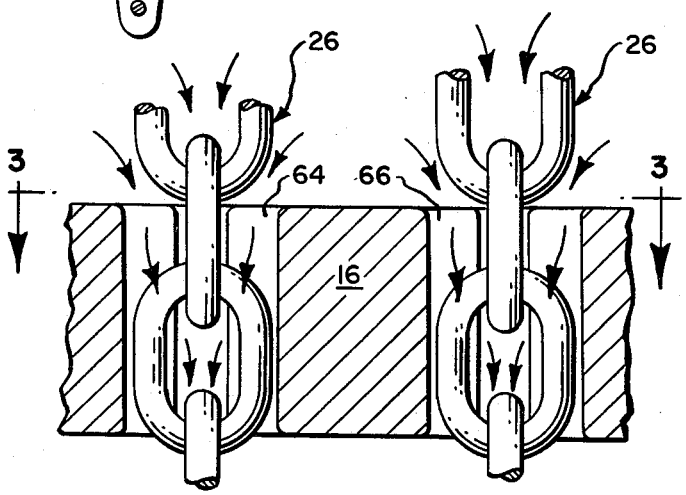
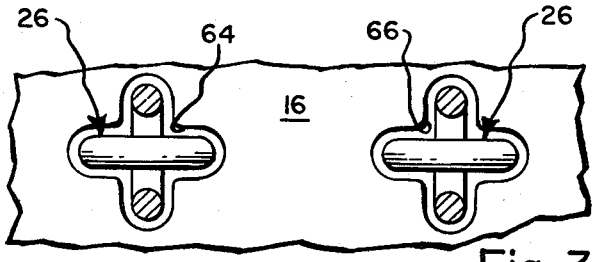
Fig. 3.

PNEUMATIC POWERED HOIST

BACKGROUND, OBJECTS AND SUMMARY OF THE INVENTION

This invention relates to pneumatic powered chain or cable hoists or the like such as are shown for example in U.S. Pat. No. 3,125,200.

Heretofore, such hoists have been noted for being extremely "noisy" in that their air exhausts are notably both shrill and staccato because of the thermodynamic limitations which are imposed upon typical type positive displacement motors resulting in incomplete air expansion cycles of operation, whereby the air exhausts from such motors are inherently in the form of rapidly expanding high pressure bursts. Also, the compressed air supply to such motors typically includes water-oil vapors carried over from the compressor and/or deliberately introduced by means of a lubricator coupled into the air supply line. Vane type air motors especially require oil to be added into the air supply line, so as to aid in sealing, lubricating and cleaning the sliding elements of the motor. Accordingly, the exhausts from a typical pneumatic hoist as above referred to are highly objectionable from the environmental standpoint by reason of their noise outputs as well as by reason of the exhaust oil vapor being pumped into the ambient atmosphere.

The object of the present invention is to provide an improved pneumatic motor powered hoist wherein the motor exhaust acoustic effects are substantially muffled interiorly of the hoist casing which is sealed to the atmosphere except through close clearance load lift means guide apertures permitting ingress and egress of the hoist load carrying means. As the vapor exhausts from the motor expand and cool, they are employed to flow and circulate throughout the entire interior of the hoist casing, thereby simultaneously cooling and lubricating the relatively moving parts of the hoist mechanism. These vapors then exit from the casing through close clearance lift means guide apertures, thereupon further expanding and projecting upon and cooling and lubricating the load carrying chain or cable prior to its running back and forth over the hoist lift wheel.

BRIEF DESCRIPTION OF THE DRAWINGS

Reference should now be had to the following detailed description taken in conjunction with the accompanying drawings, wherein:

FIG. 1 is a front elevational view of the hoist according to the present invention;

FIG. 2 is a fragmentary view taken substantially along line 2—2 of FIG. 1;

FIG. 3 is a fragmentary sectional view taken substantially along line 3—3 of FIG. 2.

DETAILED SPECIFICATION

Figure 4:
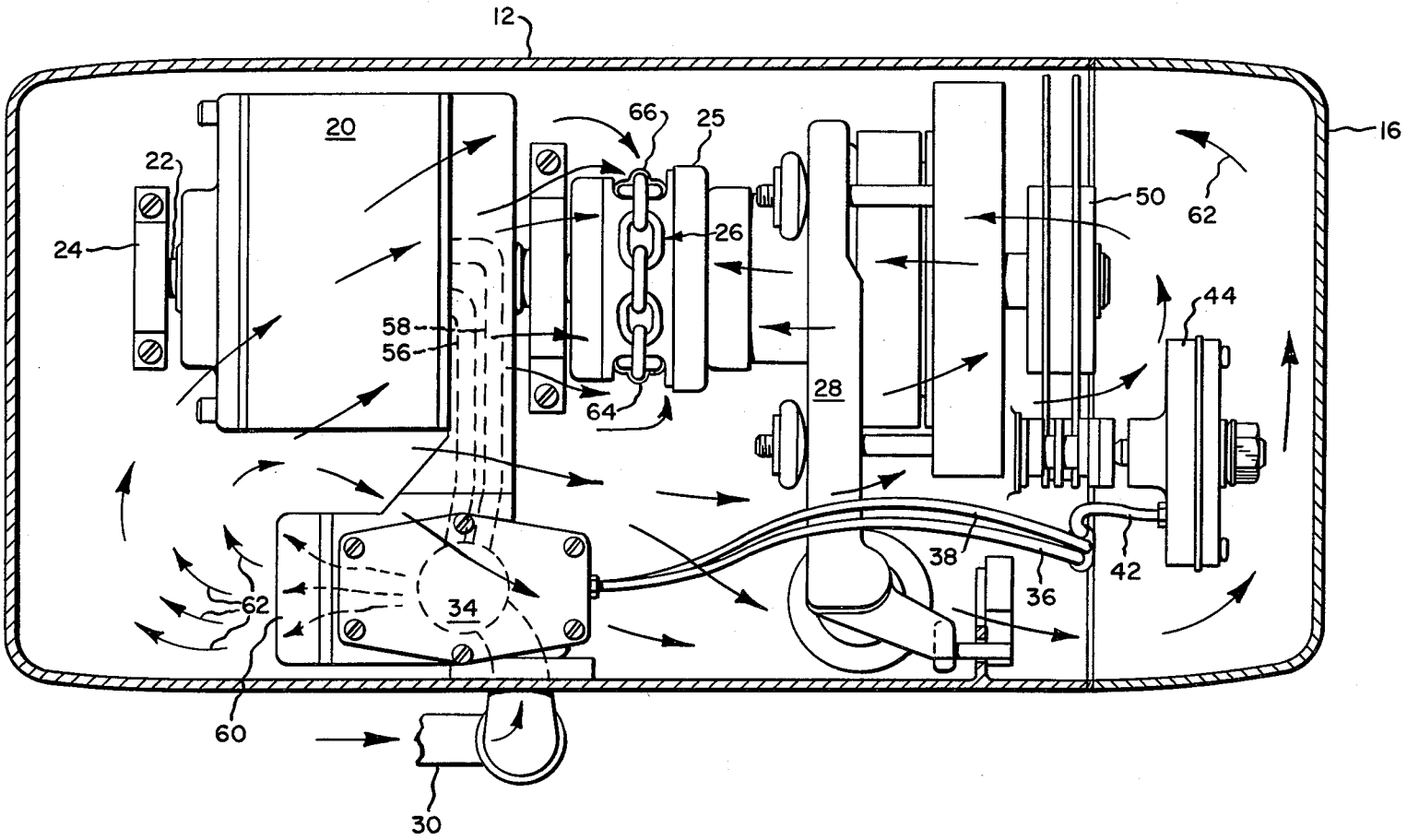
FIG. 4 is a cross-sectional view taken substantially along line 4—4 of FIG. 1.

Referring to FIG. 1, a pneumatic motor powered chain hoist as is designated generally by numeral 10 is illustrated by way of example to include a three-piece housing comprising a top shell 12; a bottom shell 14 and an end shell 16. As shown at FIG. 4, the housing encloses a compressed air (pneumatic) powered motor 20 having a drive shaft 22 mounted on bearings 24 and which is coupled to a chain lift wheel 25 about which trains the load carrying chain 26 of the hoist. At FIG. 4, there is also shown a torque limiting overload clutch as is designated generally by the numeral 28, which is desirable but not involved with the present invention. The motor 20 may be of the rotary vane or any other positive displacement type such as are well known in the art, and is typically powered by way of a high pressure compressed air feed line as is illustrated at 30 (FIGS. 1 and 4). As shown at FIG. 1, an oil supply lubricator 32 is also typically employed in connection with the compressed air supply conduit, so as to insure adequate lubrication of the relatively moving parts of the motor system.

The compressed air supply to the motor 20 is also shown as being typically controlled by means of a shuttle valve device such as is indicated at 34 (FIG. 4) which leads the air supply to the motor for alternate up and down operations, and which is under control of a pair of control lines 36,38 leading downwardly from the hoist to a pendant control device 40 which is thus disposed with convenient access to the hoist operator. As shown at FIG. 1, the control system leading to the pendant 40 includes not only the shuttle valve control lines 36,38 but also a control line 42 leading to the brake control solenoid 44 which controls actuation of the hoist brake 50. The control pendant 40 typically includes "up" and "down" buttons 52,54 which are of the variable speed control type whereby the hoist operator may, by judicious operation of the control buttons, operate the hoist to raise or lower its load at the desired rate of operation. Controls of the motor and brake by means of the pendant 40 may be via pneumatic or electrical or mechanical means or the like, such as may be preferred.

As shown at FIG. 4, the control valve 34 communicates with the motor 20 by means of conduits 56,58 which function alternately to supply air to the motor and to carry the exhaust from the motor back through the shuttle valve 34 under control of the valve 34 which in turn is under control of the pendant 40, whereby the motor may be driven in opposite directions or up-down operation of the hoist. In any case, the exhaust air passing through the valve 34 exits therefrom through a filter 60 which functions not only to remove from the exhaust stream any mechanical wear result particles, but also functions to somewhat muffle the noise of the motor exhaust. Preferably, the filter 60 may be of the screen type and will be furnished of such size and configuration as to perform its intended purpose while avoiding any unacceptable icing buildup problems due to expansion of the water/oil vapor passing through the system. In any case, however, any minor buildups of ice on the filter will be self-limiting because in this event the rate of air flow therethrough will be reduced to an equalized rate. Furthermore of course, the filter will be dimensioned so as to avoid imposing undesired back pressures on the motor operation.

As best illustrated by FIG. 4, it will thus be understood that as the relatively cold oil-laden vapor exits from the filter 60 into the interior of the hoist casing it is thereby forced to flow and circulate throughout the interior of the casing about the mechanisms enclosed therein, such as is illustrated by the air flow arrows 62. This furnishes a constant cooling and lubricating facility for the relatively moving parts of the hoist; the vapor flow terminating in exits through the two restricted chain guide ports 64,66 (FIGS. 2, 3 and 4). The heretofore still somewhat compressed air/oil mix thereupon further expands into the ambient atmosphere and is directed upon and concentrates its further cooling and lubricating effects on the chain 26; the lubricant then clinging upon the chain parts instead of being dissipated into the atmosphere of the work room.

Thus, as illustrated and explained hereinabove, the compressed air supplied to the hoist motor which includes a perceptible oil content is beneficially utilized upon exhaust into the interior of the substantially sealed hoist casing to cool and lubricate the relatively moving mechanical parts of the hoist; and finally the chilled vapor of the exhaust is beneficially concentrated upon the load carrying chain per se instead of being undesirably dispersed into the work room atmosphere. Furthermore, and as importantly, the fact that the high pressure exhaust bursts from the motor travel successively through the filter; and substantially closed plenum of the hoist casing; and then through the chain guides, the fluctuating components of the motor exhaust are acoustically leveled off; eliminating the objectionable high decibel outputs inherent upon operation of such motors. Thus, the hoist operation is quiet compared to prior art pneumatically powered hoists, and the links of the chain (including the interlinking surfaces thereof) are pressure-lubricated and cooled during operation of the hoist.

What is claimed is:

1. A compressed air powered hoist comprising a casing housing the parts of the hoist mechanism including the hoist motor;

said casing being pneumatically sealed except for having close-clearance load carrying means guide openings therethrough; said hoist motor being so arranged within said casing that the exhaust vapors from said hoist motor are discharged into the interior of said casing while expanding and cooling the mechanisms enclosed within said casing;

said vapors finally exiting through said guide openings while further expanding and cooling the load carrying means occupying said guide openings and attenuating and eliminating the high decibel acoustic vibrations issuing initially from the motor exhaust ports.

2. A compressed air powered hoist as set forth in claim 1 wherein said parts include a shuttle valve operable to alternately deliver and exhaust air from opposite air transport ports of said motor, the exhausts from said motor issuing through said valve into the interior of said casing.

3. A compressed air powered hoist as set forth in claim 2 wherein a filter device is attached to the outlet port of said valve.

4. A compressed air powered hoist as set forth in claim 1 wherein the load carrying means is of the chain type.

5. A compressed air powered hoist as set forth in claim 4 wherein the compressed air supply line into said valve includes means for adding lubricant to the compressed air supply.

6. A compressed air powered hoist as set forth in claim 5 wherein said valve is controlled from and externally of said hoist casing by means of a pendant control device suspended from said casing.

* * * * *